US006881160B2

(12) United States Patent
Endo et al.

(10) Patent No.: US 6,881,160 B2
(45) Date of Patent: Apr. 19, 2005

(54) GOLF BALL

(75) Inventors: Seiichiro Endo, Kobe (JP); Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/766,888

(22) Filed: Jan. 30, 2004

(65) Prior Publication Data

US 2004/0185966 A1 Sep. 23, 2004

(30) Foreign Application Priority Data

Feb. 26, 2003 (JP) ..... 2003-049218
Mar. 14, 2003 (JP) ..... 2003-069236

(51) Int. Cl.[7] ..... A63B 37/14
(52) U.S. Cl. ..... 473/384
(58) Field of Search ..... 473/378–385

(56) References Cited

U.S. PATENT DOCUMENTS 4,813,677 A 3/1989 Oka et al.
4,869,512 A * 9/1989 Nomura et al. ..... 473/383
5,143,377 A * 9/1992 Oka et al. ..... 473/383
5,174,578 A * 12/1992 Oka et al. ..... 473/384
5,192,078 A * 3/1993 Woo ..... 473/379
5,292,132 A 3/1994 Oka
6,695,721 B1 * 2/2004 Tavares et al. ..... 473/384
2002/0119838 A1 8/2002 Moriyama
2003/0171167 A1 * 9/2003 Kasashima ..... 473/378

FOREIGN PATENT DOCUMENTS

JP 62-192181 A 8/1987
JP 04-347177 A 12/1992
JP 2002-186684 A 2/2002

* cited by examiner

*Primary Examiner*—Raeann Gorden
(74) *Attorney, Agent, or Firm*—Brich, Stewart, Kolasch & Birch, LLP

(57) ABSTRACT

A golf ball 1 includes an A dimple having a diameter of 4.35 mm, a B dimple having a diameter of 3.9 mm, a C dimple having a diameter of 3.4 mm, and a D dimple having a diameter of 3.2 mm. All the dimples have circular plane shapes. A ratio PN of a number Na of the circular dimples having the diameters of 3.9 mm to 4.8 mm to a total number N of the dimples is 75% or more. A volume Va of the circular dimples having the diameters of 3.9 mm to 4.8 mm is 200 $mm^3$ to 300 $mm^3$. A ratio PV of the volume Va to a total volume V of all the dimples is 70% to 95%. A surface area occupation ratio Y of all the dimples is 75% or more.

3 Claims, 9 Drawing Sheets

C C B B B C B A B C B B B C C
B C B B B

A
B
A
A
A
A
A
A
A
A
A
A
A
A
B
A
B
A
A
A
A
A
A
A
A
A
A
A
A

GOLF BALL

This Nonprovisional application claims priority under 35 U.S.C. § 119(a) on Patent Application No(s). 2003-049218 and 2003-069236 filed in JAPAN on Feb. 26, 2003 and Mar. 14, 2003, the entire contents of which are hereby incorporated by reference.

BACKGROUND OF THE INVENTION

1. Field of the Invention

The present invention relates to a golf ball. More particularly, the present invention relates to an improvement in a dimple pattern of the golf ball.

2. Description of the Related Art

A golf ball flies with a backspin by hitting. The golf ball then drops and rolls over the ground, and comes to rest. A distance from a hitting point to a drop point is referred to as a carry. A distance from the drop point to a rest point is referred to as a run (or a roll). A distance from the hitting point to the rest point is referred to as a total distance.

A golf ball has a large number of dimples on a surface thereof. The dimple usually takes a circular plane shape. A non-circular dimple has also been proposed. In respect of an aerodynamic symmetry and the easiness of the manufacture of a mold, a circular dimple is a mainstream in golf balls put on the market.

The role of the dimples resides in one aspect that such dimples disturb an air stream around the golf ball during a flight, thereby causing a turbulent flow separation (which will be hereinafter referred to as a "dimple effect"). The separation of the turbulent flow causes a separating point of air from the golf ball to be shifted backward so that a drag coefficient (Cd) is reduced. The separation of the turbulent flow increases a differentia between the upper and lower separating points of the golf ball which is caused by a backspin. Consequently, a lift acting on the golf ball is increased. A reduction in a drag and an enhancement in a lift cause the flight distance of the golf ball to be increased. An aerodynamically excellent dimple promotes the separation of the turbulent flow.

Examples of the specifications to greatly influence the flight performance of a golf ball include a density of dimples (which is also referred to as a "surface area occupation ratio") A golf ball having a high density is excellent in a flight performance. Various proposals for the density have been made. Japanese Laid-Open Patent Publication No. Sho 62-192181 has disclosed a golf ball in which dimples are densely provided in such a manner that a new dimple having an area which is equal to or more than a mean area cannot be formed. Japanese Laid-Open Patent Publication No. Hei 4-347177 has disclosed a golf ball in which dimples are provided very densely and the number of lands in which a rectangle having a predetermined dimension can be drawn is 40 or less. Japanese Laid-Open Patent Publication No. 2002-186684 has disclosed a golf ball in which a surface area occupation ratio and a dimple contour length satisfy a predetermined relationship.

Examples of other specifications to greatly influence the flight performance of a golf ball include a total volume of dimples. In the case in which the total volume is small, the trajectory of the golf ball tends to be high. On the other hand, in the case in which the total volume is large, the trajectory of the golf ball tends to be low.

Although a great carry can be obtained in a high trajectory, the speed of the golf ball is low during dropping so that a run is small. In the case in which the total volume is small, a total distance is insufficient. In a low trajectory, the run is great and the carry is small. Also in the case in which the total volume is large, the total distance is insufficient. In addition, in the case in which the trajectory is low, a variation in the carry is great.

Thus, the run is small in a golf ball having a great carry and the carry is small in a golf ball having a great run. The maximum demand for a golf ball of a golf player is a flight distance. In particular, the golf player attaches importance to a total distance obtained by hitting through a driver. It is an object of the present invention to provide a golf ball giving a great total distance.

SUMMARY OF THE INVENTION

The present invention provides a golf ball including:

(a) at least two types of circular dimples having diameters of 3.9 mm to 4.8 mm; and (b) a non-circular dimple or a circular dimple having a diameter of less than 3.9 mm. A ratio PN of a number Na of the circular dimples having the diameters of 3.9 mm to 4.8 mm to a total number N of the dimples is 75% or more. A volume Va of the circular dimples having the diameters of 3.9 mm to 4.8 mm is 200 $mm^3$ to 300 $mm^3$. A ratio PV of the volume Va to a total volume V of all the dimples is 70% to 95%. A surface area occupation ratio Y of all the dimples is 75% or more. In the golf ball, a carry is great, and furthermore, a run is great. In the golf ball, a total distance is great.

It is preferable that a surface area occupation ratio Ya of the circular dimples having the diameters of 3.9 mm to 4.8 mm should be 65% or more. The golf ball is excellent in a flight performance.

It is preferable that a difference between a diameter of the largest one of the circular dimples having the diameters of 3.9 mm to 4.8 mm and that of the smallest one of the circular dimples having the diameters of 3.9 mm to 4.8 mm should be 0.6 mm or less. In the golf ball, a very great carry can be obtained.

DESCRIPTION OF THE PREFERRED EMBODIMENTS

The present invention will be described below in detail based on a preferred embodiment with reference to the drawings.

Figure 1:
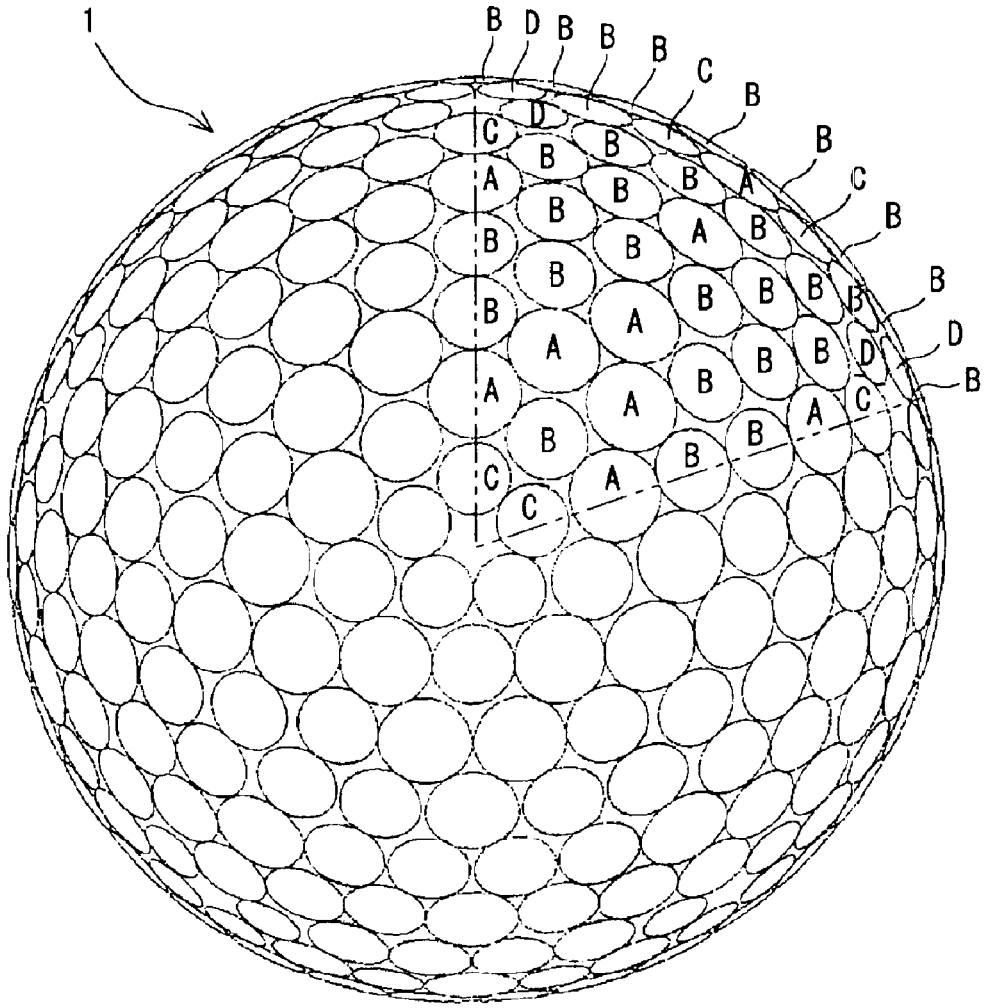
FIG. 1 is a front view showing a golf ball according to an embodiment of the present invention.

A golf ball 1 shown in FIG. 1 usually has a diameter of 40 mm to 45 mm, and furthermore, 42 mm to44 mm. From the viewpoint of the fact that an air resistance is reduced within such a range as to satisfy the standards of the U.S. Golf Association (USGA), it is particularly preferable that the diameter should be 42.67 mm to 42.85 mm. The golf ball 1 usually has a weight of 40 g to 50 g, and furthermore, 44 g to 47 g. From the viewpoint of the fact that an inertia is increased within such a range as to satisfy the standards of the USGA, it is particularly preferable that the weight should be 45.00 g to 45.93 g.

The golf ball 1 includes an A dimple having a circular plane shape and a diameter of 4.35 mm, a B dimple having a circular plane shape and a diameter of 3.9 mm, a C dimple having a circular plane shape and a diameter of 3.4 mm, and a D dimple having a circular plane shape and a diameter of 3.2 mm. In this specification, the term of "plane shape" implies a shape of a contour line to be a boundary between a phantom spherical surface and a dimple as seen at infinity. The golf ball 1 includes two types of circular dimples having diameters of 3.9 mm to 4.8 mm (more specifically, the A dimple and the B dimple). The golf ball 1 includes two types of circular dimples having diameters of less than 3.9 mm (more specifically, the C dimple and the D dimple). FIG. 1 shows one of ten equivalent units obtained by partitioning the surface of the golf ball 1, the types of dimples being indicated as A to D. A two-dotted chain line in FIG. 1 is a phantom line representing a boundary between the units.

In the golf ball 1 shown in FIG. 1, the number of the A dimples is 70, that of the B dimples is 260, that of the C dimples is 40, and that of the D dimples is 40. A total number N of the dimples of the golf ball 1 is 410. In the golf ball 1, a number Na of circular dimples having diameters of 3.9 mm to 4.8 mm is 330. A ratio PN of the number Na to the total number N is 80.5%.

Figure 2:
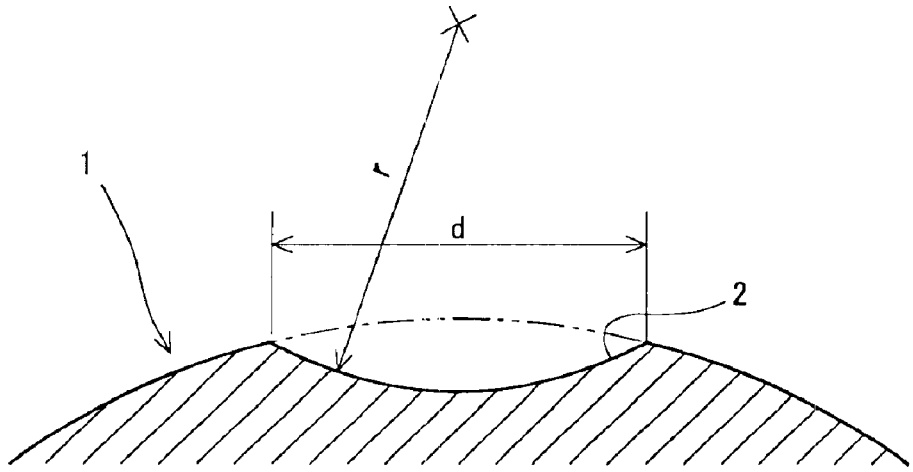
FIG. 2 is a typical enlarged sectional view showing a part of the golf ball in FIG. 1.

FIG. 2 is a typical enlarged sectional view showing a part of the golf ball 1 in FIG. 1. FIG. 2 shows a planar section taken along a center of gravity of the plane shape of a circular dimple 2 and a center of the golf ball 1. As is apparent from FIG. 2, the dimple 2 takes the sectional shape of an almost circular arc. In other words, the surface of the dimple 2 constitutes a part of a spherical surface. The dimple 2 is referred to as a single radius dimple. As a matter of course, the circular dimple 2 having another sectional shape may be employed. In FIG. 2, a phantom spherical surface (a spherical surface obtained when it is assumed that the dimple 2 is not present) is shown in a two-dotted chain line. In FIG. 2, an arrow d indicates a diameter of the dimple 2. The diameter d is equivalent to a distance between both contact points which is obtained when a common tangential line is drawn on both ends of the dimple 2. The continuous contact point forms a contour line. In FIG. 2, an arrow r indicates a curvature of the section of the dimple 2.

In this specification, a "total volume V" implies the sum of volumes v of all the dimples 2. The "volume v of the dimple" implies the volume of a portion surrounded by a plane including a contour line and the surface of the dimple 2. In case of a non-circular dimple, there is supposed a circular single radius dimple having an equal area to the area of the non-circular dimple and an equal depth to the depth of the non-circular dimple, and the volume of the single radius dimple is defined as that of the non-circular dimple. The sum of the volumes v of the circular dimples having the diameters of 3.9 mm to 4.8 mm is represented by Va. A ratio of the volume Va to the total volume V is represented by PV (%). In the golf ball 1 shown in FIG. 1, the A dimple has a volume v of 0.967 $mm^3$, the B dimple has a volume v of 0.778 $mm^3$, the C dimple has a volume v of 0.591 mm , and the D dimple has a volume v of 0.512 $mm^3$. Accordingly, the golf ball 1 has a total volume V of 314.0 $mm^3$, a volume Va of 269.9 $mm^3$ and a ratio PV of 85.9%.

In this specification, the term of "surface area occupation ratio Y" implies a value which is 100 times as great as a value obtained by dividing the sum of the areas s of all the dimples by the surface area of a phantom sphere. The "area s of the dimple" implies the area of the plane shape of the dimple. In case of a circular dimple, the area s is calculated by the following equation.

$$s=(d/2)^2\cdot\pi$$

In this specification, a surface area occupation ratio Ya is 100 times as great as a value obtained by dividing the sum of the areas s of the circular dimples having the diameters of 3.9 mm to 4.8 mm by the surface area of the phantom sphere.

In the golf ball 1 shown in FIG. 1, the A dimple has an area s of 14.9 $mm^2$, the B dimple has an area s of 11.9 $mm^2$, the C dimple has an area s of 9.1 $mm^2$, and the D dimple has an area s of 8.0 $mm^2$. Accordingly, a sum S of the dimple areas is 4831 $mm^2$. The total area S is divided by the surface area of the phantom sphere so that the surface area occupation ratio Y is calculated. In the golf ball 1, the surface area occupation ratio Y is 84%. In the golf ball 1, the surface area occupation ratio Ya is 72%.

In the golf ball 1 according to the present invention, the ratio PN is set to be 75% or more. In other words, in the golf ball 1, there are provided a great number of large dimples which are circular and have diameters of 3.9 mm to 4.8 mm. The large dimples contribute to an enhancement in a carry. Although the reason why the large dimple contributes to the enhancement in the carry is unknown in detail, it can be guessed that a drag obtained immediately after hitting is reduced by the large dimples. In respect of the carry, the ratio PN is more preferably 78% or more and particularly preferably 79% or more. An extremely large dimple damages the smoothness of the surface of the golf ball 1. For this reason, it is preferable that a dimple having a diameter of more than 4.8 mm should not be provided.

When only the large dimples are provided on the surface of the golf ball 1, the area of a region (land) surrounded by the dimples is increased. The golf ball having a large area of the land tends to stall in the latter half of a trajectory. The stall causes a reduction in a run. In the golf ball 1 according to the present invention, circular dimples having small diameters of less than 3.9 mm are also provided in addition to the dimples having large diameters. The dimples having the small diameters suppress the generation of a land having a large area. Consequently, a high surface area occupation ratio Y can be achieved as will be described below in detail. The dimples having the large diameters and the dimples having the small diameters are provided together so that the carry and the run are consistent with each other and the total distance can be increased. In respect of the surface area occupation ratio Y, the diameter of the small dimple is more preferably 3.7 mm or less and particularly preferably 3.5 mm or less. An extremely small dimple cannot contribute to an aerodynamic characteristic. For this reason, the diameter of the small dimple is preferably 2.0 mm or more and particularly preferably 2.5 mm or more. A non-circular dimple may be provided together with the dimple having a small diameter or in place thereof. The non-circular dimple is easily provided in a region surrounded by the circular dimples having large diameters. The non-circular dimple can also suppress the stall in the same manner as the dimple having a small diameter.

As described above, the golf ball 1 has two types of dimples having large diameters. By providing at least two types of dimples having large diameters, the dimples can be arranged on the surface of the golf ball 1 more densely as compared with the case in which a single type of dimple having a large diameter is provided. Consequently, a high surface area occupation ratio Y can be achieved as will be described below in detail. In the present invention, it is decided that different types of dimples have a difference between diameters of 0.1 mm. In respect of the surface area occupation ratio Y, a difference between the diameter of the largest one of circular dimples having diameters of 3.9 mm to 4.8 mm and the diameter of the smallest one of the circular dimples having the diameters of 3.9 mm to 4.8 mm is preferably 0.1 mm or more and particularly preferably 0.15 mm or more. In some cases in which a difference between the diameters of the large dimples is too great, an air flow is excessively disturbed so that the flight performance of the golf ball 1 is damaged. From this viewpoint, the difference between the diameter of the largest one of the circular dimples having the diameters of 3.9 mm to 4.8 mm and the diameter of the smallest one of the circular dimples having the diameters of 3.9 mm to 4.8 mm is preferably 0.6 mm or less, more preferably 0.55 mm or less, more preferably 0.45 mm or less, more preferably 0.30 mm or less, and particularly preferably 0.25 mm or less. Each of the numbers of the types of the dimples having small diameters and the non-circular dimples may be one or more.

In the golf ball 1 according to the present invention, the surface area occupation ratio Y is set to be 75% or more. In some cases in which the surface area occupation ratio Y is less than the range, the golf ball 1 stalls in the latter half of a trajectory so that a run is insufficient. From this viewpoint, the surface area occupation ratio Y is more preferably 78% or more and particularly preferably 80% or more. The surface area occupation ratio Y obtained usually is 90% or less, and particularly 86% or less.

It is preferable that the surface area occupation ratio Ya of the circular dimple having the diameter of 3.9 mm to 4.8 mm should be 65% or more. In some cases in which the surface area occupation ratio Ya is less than the range, a carry is insufficient. From this viewpoint, the surface area occupation ratio Ya is more preferably 68% or more and particularly preferably 70% or more. If the surface area occupation ratio Ya is too high, the number of the dimples having small diameters (or the non-circular dimples) is decreased. In some cases in which the number of the dimples having the small diameters is small, the run is reduced due to the stall of the golf ball 1. From this viewpoint, the surface area occupation ratio Ya is preferably 80% or less and particularly preferably 75% or less.

In the golf ball 1 according to the present invention, it is preferable that the total volume V should be 250 $mm^3$ to 380 $mm^3$. If the total volume V is less than the range, the run might be insufficient. From this viewpoint, the total volume V is more preferably 270 $mm^3$ or more and particularly preferably 290 $mm^3$ or more. If the total volume V is more than the range, the carry might be insufficient. From this viewpoint, the total volume V is more preferably 375 $mm^3$ or less and particularly preferably 370 $mm^3$ or less.

In the golf ball 1 according to the present invention, the volume Va is set to be 200 $mm^3$ to 300 $mm^3$. If the volume Va is less than the range, the carry might be insufficient. From this viewpoint, the volume Va is more preferably 210 $mm^3$ or more and particularly preferably 220 $mm^3$ or more. If the volume Va is more than the range, the run might be insufficient. From this viewpoint, the volume Va is more preferably 295 $mm^3$ or less.

In the golf ball 1 according to the present invention, the ratio PV is set to be 70% to 95%. If the ratio PV is less than the range, the carry might be insufficient. From this viewpoint, the ratio PV is more preferably 75% or more and particularly preferably 80% or more. If the ratio PV is more than the range, the run might be insufficient. From this viewpoint, the ratio PV is more preferably 90% or less.

It is preferable that the total number N of the dimples 2 should be 240 to 500. In some cases in which the total number N is less than the range, the smoothness of the surface of the golf ball is damaged. From this viewpoint, the total number N is more preferably 280 or more and particularly preferably 290 or more. In some cases in which the total number N is more than the range, a drag coefficient (Cd) is increased so that the carry is in sufficient. From this view point, the total number N is more preferably 480 or less and particularly preferably 450 or less.

It is preferable that the depth of each of the dimples should be 0.05 mm to 0.60 mm. In some cases in which the depth is less than the range, the aerodynamic characteristic of the golf ball 1 is insufficient. From this viewpoint, the depth is more preferably 0.075 mm or more and particularly preferably 0.10 mm or more. If the depth is more than the range, soil is apt to collect in the dimple 2. From this viewpoint, the depth is more preferably 0.50 mm or less and particularly preferably 0.45 mm or less. The depth implies a distance between a plane including the contour line of the dimple 2 and the deepest portion of the dimple 2.

In the molding of the golf ball 1, a dimple cannot be formed on the parting line of a mold. When a mold having a circular parting line is used, a great circle path which does not cross a dimple is formed on the surface of the golf ball 1. The great circle path is a land having a large area. The stall of the golf ball 1 is promoted by the great circle path. In addition, an aerodynamic symmetry is damaged. In the golf ball 1 according to the present invention, it is preferable that a mold having a concavo-convex parting line should be used. By the mold, the golf ball 1 having no great circle path can be formed.

The dimple pattern described above can be employed for a solid golf ball comprising a solid core and a cover, a wound golf ball and a one-piece golf ball. The same dimple pattern can also be employed for a solid golf ball using a solid core having at least two layers and a solid golf ball using a cover having at least two layers.

EXAMPLES

Example 1

100 parts by weight of high cis-polybutadiene (trade name of "BRO1" manufactured by JSR Co., Ltd.), 25 parts by weight of zinc acrylate, a predetermined amount of zinc oxide, 0.65 part by weight of dicumyl peroxide and 0.48 part by weight of diphenyl disulfide were kneaded so that a rubber composition was obtained. The rubber composition was put in a mold and was held for 25 minutes at a temperature of 160° C. so that a spherical core having a diameter of 39.9 mm was obtained. On the other hand, 45parts by weight of an ionomer resin (trade name of "Surlyn 8945" manufactured by Dupont Co., Ltd.), 45 parts by weight of another ionomer resin (trade name of "Surlyn 9945" manufactured by Dupont Co., Ltd.) and 10 parts by weight of thermoplastic styrene elastomer (trade name of "Rabalon SR04" manufactured by Mitsubishi Chemical Corporation) were kneaded so that a resin composition was obtained. Next, a core was put in another mold and the resin composition was injected around the core to form a cover. Coating was carried out over the surface of the cover so that a golf ball having a weight of 45.4 g and a diameter of 42.7 mm according to an example 1 was obtained. The specification of the dimple of the golf ball is shown in the following Table 1.

Examples 2 to 5 and Comparative Examples 1 to 6

Golf balls according to examples 2 to 5 and comparative examples 1 to 6 were obtained in the same manner as in the example 1 except that a mold was changed and the specification of a dimple was set as shown in the following Tables 1 to 3.

TABLE 1

Figure 3:
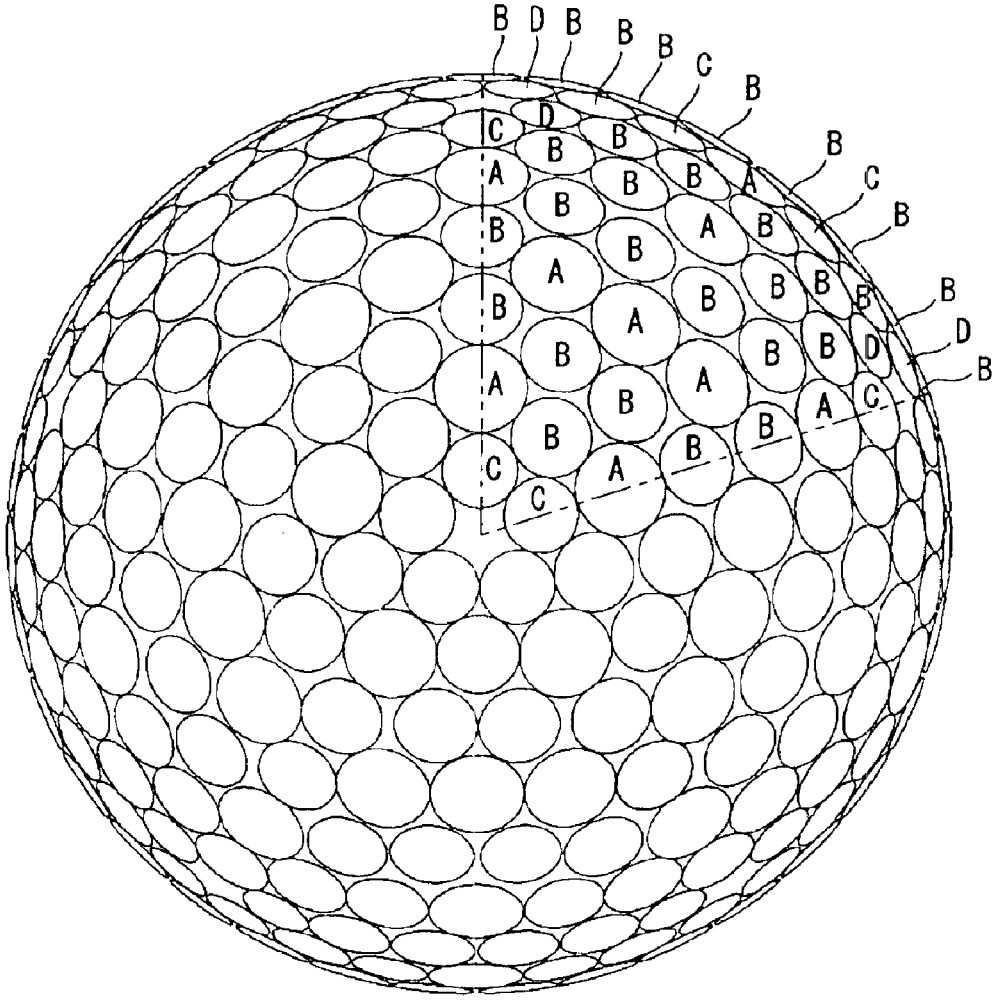
FIG. 3 is a front view showing a golf ball according to an example 2 of the present invention and comparative examples 2 and 3.
Figure 4:
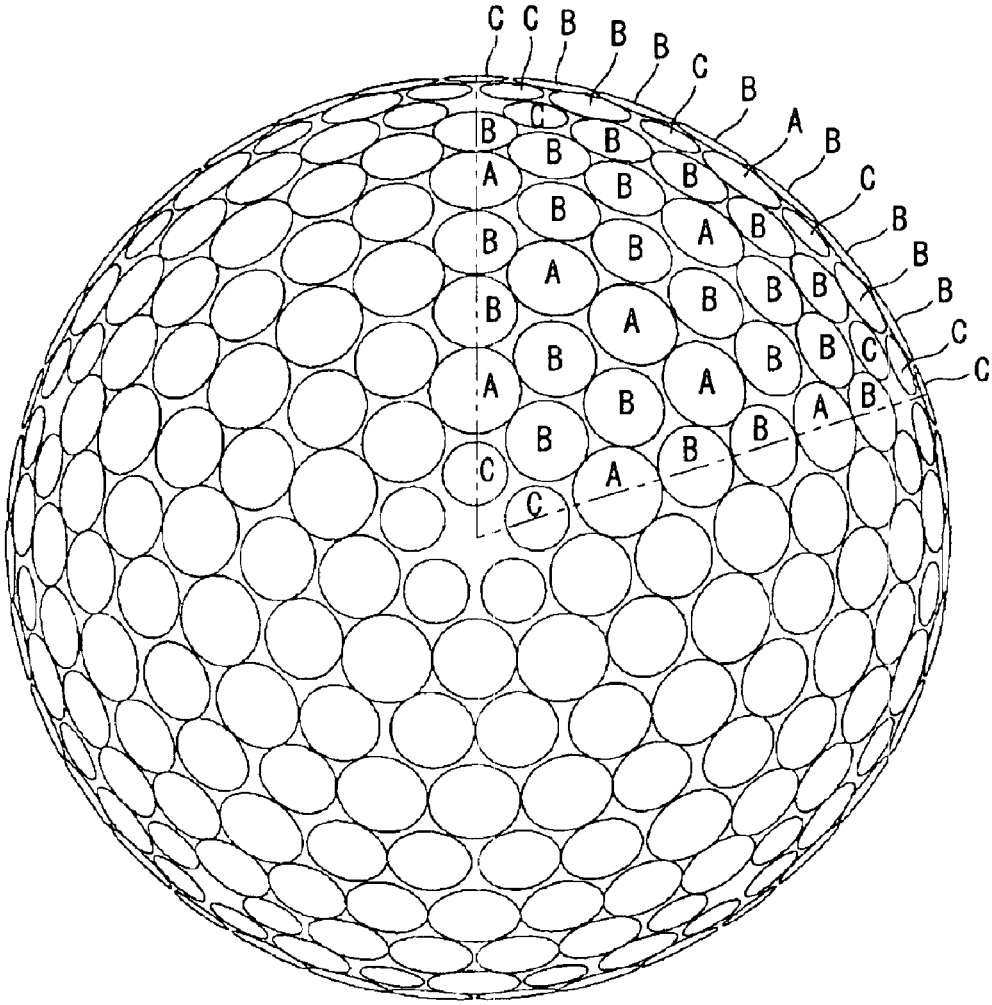
FIG. 4 is a front view showing a golf ball according to examples 3 and 4 of the present invention.

| | Specification of dimple | | | | | | | | | | | |
|---|---|---|---|---|---|---|---|---|---|---|---|---|
| | | Number | | | | Spherical | | Volume | | Area | | |
| | Type | Number n | ratio (%) | Diameter d (mm) | Depth (mm) | surface depth (mm) | Curvature r (mm) | v ($mm^3$) | v · n ($mm^3$) | s ($mm^2$) | s · n ($mm^2$) | Dimple pattern |
| Example 1 | A | 70 | 17.1 | 4.350 | 0.1300 | 0.2411 | 18.260 | 0.967 | 67.7 | 14.9 | 1040 | FIG. 1 |
| | B | 260 | 63.4 | 3.900 | 0.1300 | 0.2192 | 14.690 | 0.778 | 202.2 | 11.9 | 3106 | |
| | C | 40 | 9.8 | 3.400 | 0.1300 | 0.1978 | 11.180 | 0.591 | 23.7 | 9.1 | 363 | |
| | D | 20 | 9.8 | 3.200 | 0.1270 | 0.1870 | 10.142 | 0.512 | 20.5 | 8.0 | 322 | |
| Example 2 | A | 70 | 17.1 | 4.450 | 0.1300 | 0.2463 | 19.106 | 1.012 | 70.8 | 15.6 | 1089 | FIG. 3 |
| | B | 260 | 63.4 | 3.900 | 0.1300 | 0.2192 | 14.690 | 0.778 | 202.2 | 11.9 | 3106 | |
| | C | 40 | 9.8 | 3.500 | 0.1200 | 0.1918 | 12.820 | 0.578 | 23.1 | 9.6 | 385 | |
| | D | 40 | 9.8 | 3.300 | 0.1200 | 0.1839 | 11.404 | 0.514 | 20.6 | 8.6 | 342 | |
| Example 3 | A | 70 | 17.1 | 4.150 | 0.1380 | 0.2391 | 15.669 | 0.935 | 65.4 | 13.5 | 947 | FIG. 4 |
| | B | 260 | 63.4 | 3.900 | 0.1380 | 0.2272 | 13.846 | 0.826 | 214.7 | 11.9 | 3106 | |
| | C | 80 | 19.5 | 2.800 | 0.1370 | 0.1830 | 7.222 | 0.423 | 33.9 | 6.2 | 493 | |
| Example 4 | A | 70 | 17.1 | 4.150 | 0.1430 | 0.2441 | 15.126 | 0.969 | 67.8 | 13.5 | 947 | FIG. 4 |
| | B | 260 | 63.4 | 3.900 | 0.1430 | 0.2322 | 13.367 | 0.856 | 222.5 | 11.9 | 3106 | |
| | C | 80 | 19.5 | 2.800 | 0.1000 | 0.1460 | 9.850 | 0.308 | 24.7 | 6.2 | 493 | |

TABLE 2

Figure 5:
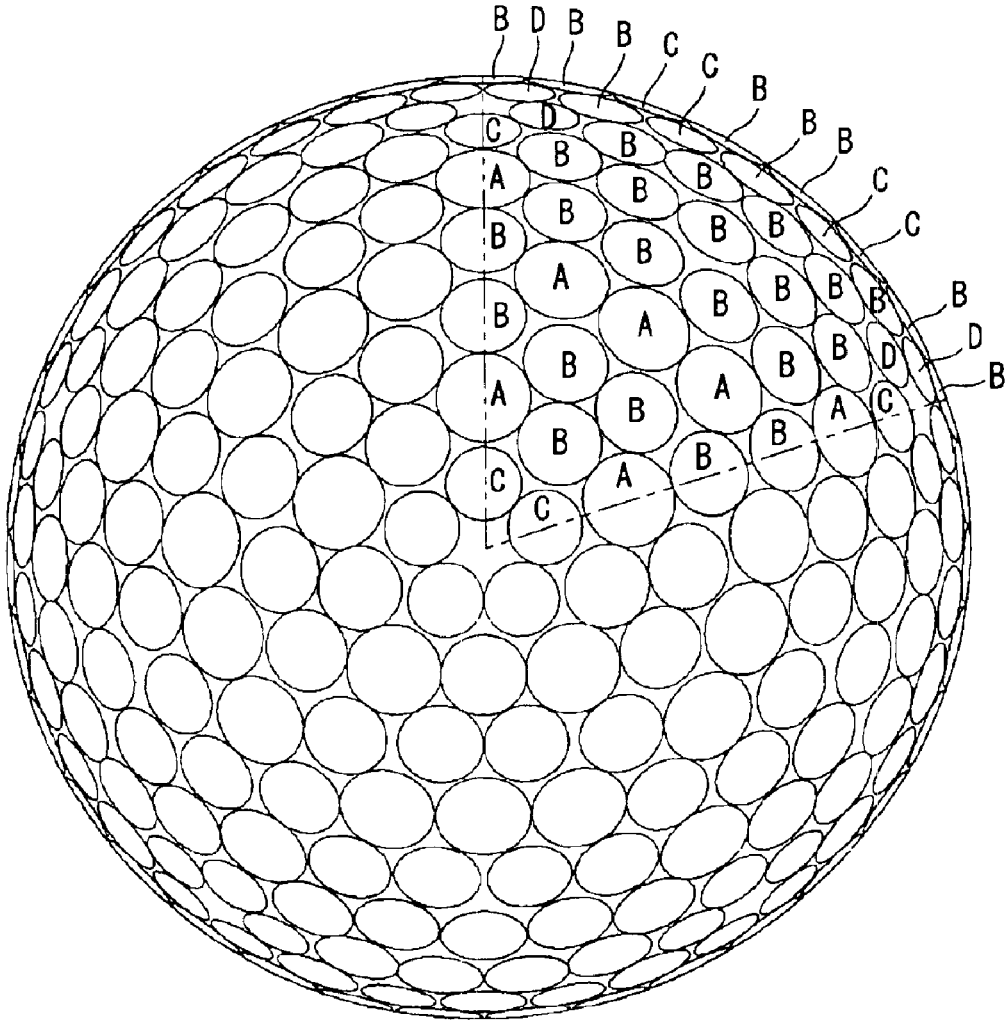
FIG. 5 is a front view showing a golf ball according to an example 5 of the present invention.
Figure 6:
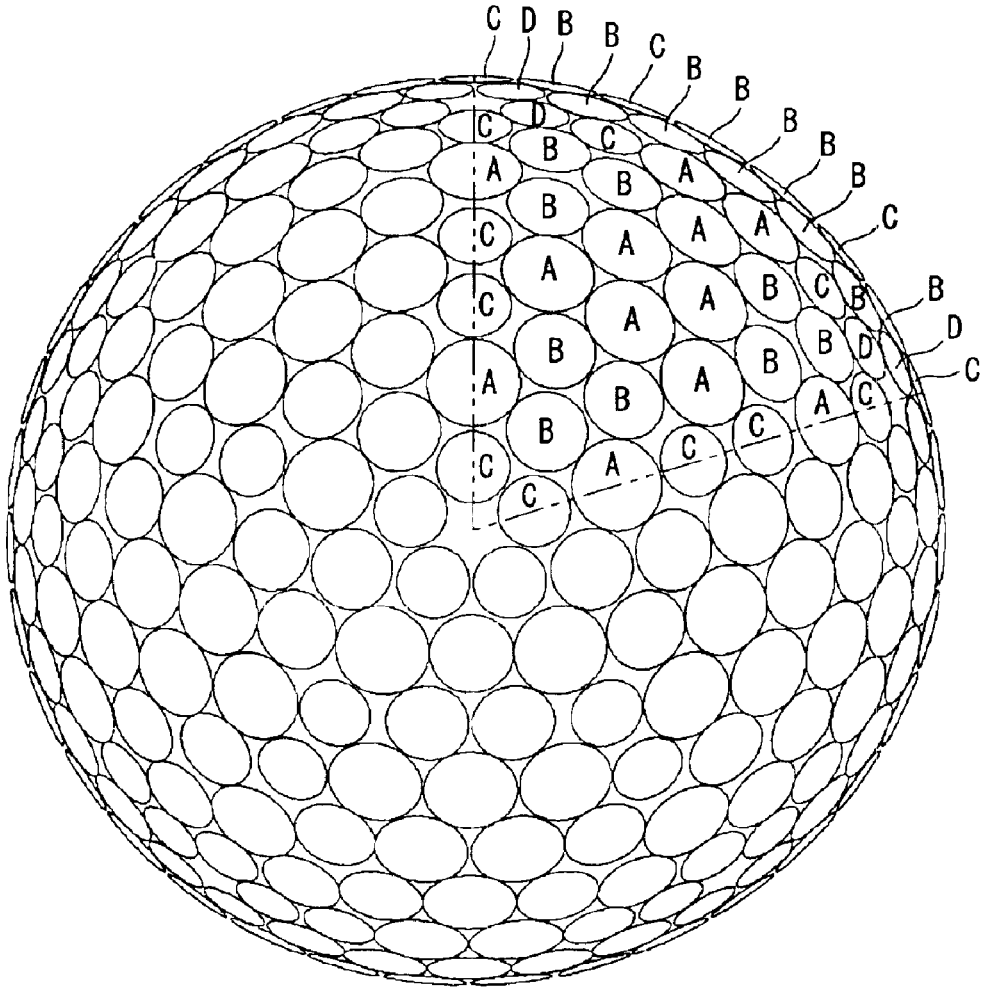
FIG. 6 is a front view showing a golf ball according to a comparative example 1.

| | Specification of dimple | | | | | | | | | | | |
|---|---|---|---|---|---|---|---|---|---|---|---|---|
| | | Number | | | | Spherical | | Volume | | Area | | |
| | Type | Number n | ratio (%) | Diameter d (mm) | Depth (mm) | surface depth (mm) | Curvature (mm) | v ($mm^3$) | v · n ($mm^3$) | s ($mm^2$) | s · n ($mm^2$) | Dimple pattern |
| Example 5 | A | 50 | 12.2 | 4.350 | 0.1330 | 0.2441 | 17.851 | 0.990 | 49.5 | 14.9 | 743 | FIG. 5 |
| | B | 260 | 63.4 | 3.900 | 0.1330 | 0.2222 | 14.362 | 0.796 | 206.9 | 11.9 | 3106 | |
| | C | 60 | 14.6 | 3.400 | 0.1300 | 0.1978 | 11.180 | 0.591 | 35.5 | 9.1 | 545 | |
| | D | 40 | 9.8 | 3.200 | 0.1300 | 0.1900 | 9.911 | 0.524 | 21.0 | 8.0 | 322 | |
| Comparative example 1 | A | 100 | 24.4 | 4.350 | 0.1310 | 0.2421 | 18.121 | 0.975 | 97.5 | 14.9 | 1486 | FIG. 6 |
| | B | 180 | 43.9 | 3.900 | 0.1310 | 0.2202 | 14.579 | 0.784 | 141.1 | 11.9 | 2150 | |
| | C | 90 | 22.0 | 3.400 | 0.1310 | 0.1988 | 11.096 | 0.596 | 53.6 | 9.1 | 817 | |
| | D | 40 | 9.8 | 3.200 | 0.1310 | 0.1910 | 9.836 | 0.528 | 21.1 | 8.0 | 322 | |
| Comparative example 2 | A | 70 | 17.1 | 4.400 | 0.1500 | 0.2637 | 16.208 | 1.142 | 80.0 | 15.2 | 1064 | FIG. 3 |
| | B | 260 | 63.4 | 3.900 | 0.1480 | 0.2372 | 12.920 | 0.886 | 230.3 | 11.9 | 3106 | |

TABLE 2-continued

| Specification of dimple | | | | | | | | | | | |
|---|---|---|---|---|---|---|---|---|---|---|---|
| | | Number | | | | Spherical | | Volume | | Area | | |
| | Type | Number n | ratio (%) | Diameter d (mm) | Depth (mm) | surface depth (mm) | Curvature (mm) | v ($mm^3$) | v · n ($mm^3$) | s ($mm^2$) | s · n ($mm^2$) | Dimple pattern |
| | C | 40 | 9.8 | 3.500 | 0.0450 | 0.1168 | 34.050 | 0.217 | 8.7 | 9.6 | 385 | |
| | D | 40 | 9.8 | 3.300 | 0.0450 | 0.1089 | 30.273 | 0.192 | 7.7 | 8.6 | 342 | |

TABLE 3

Figure 7:
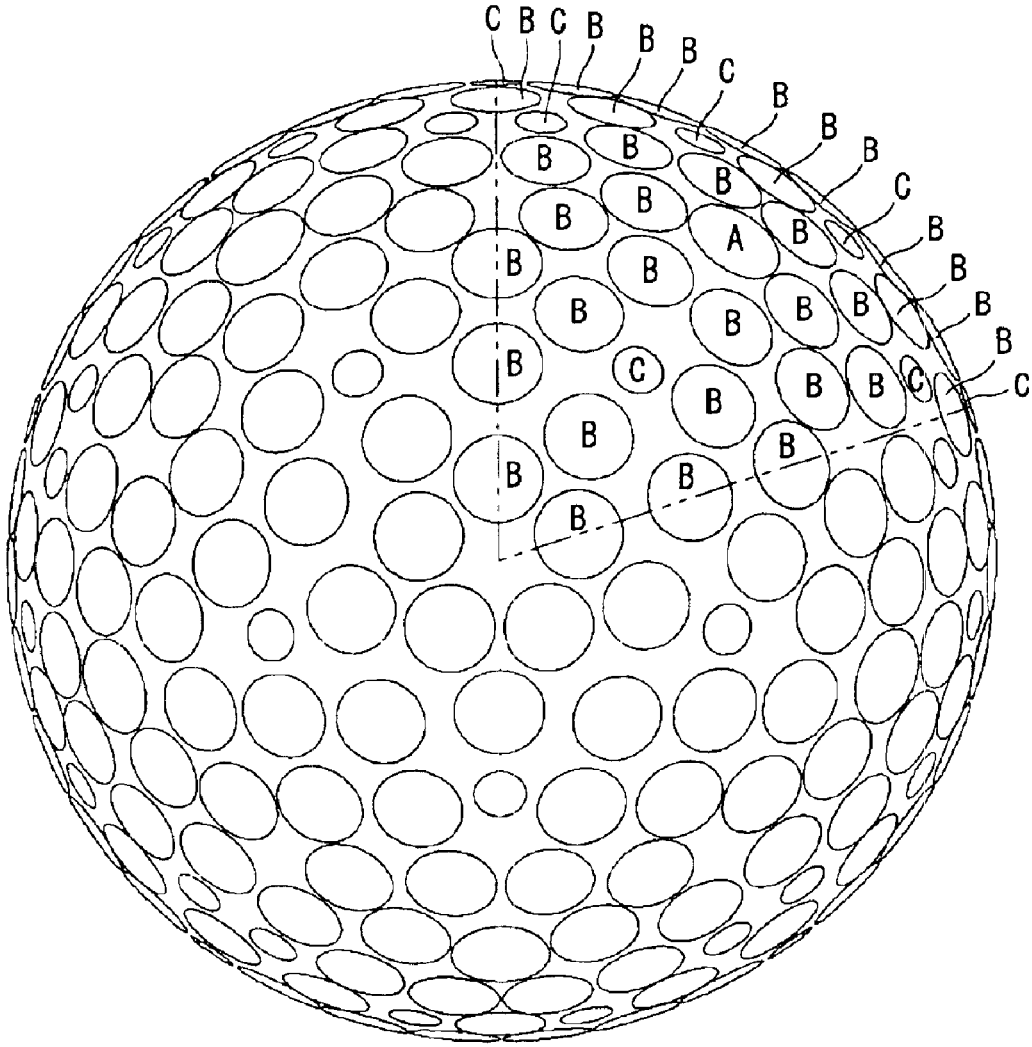
FIG. 7 is a front view showing a golf ball according to a comparative example 4.
Figure 8:
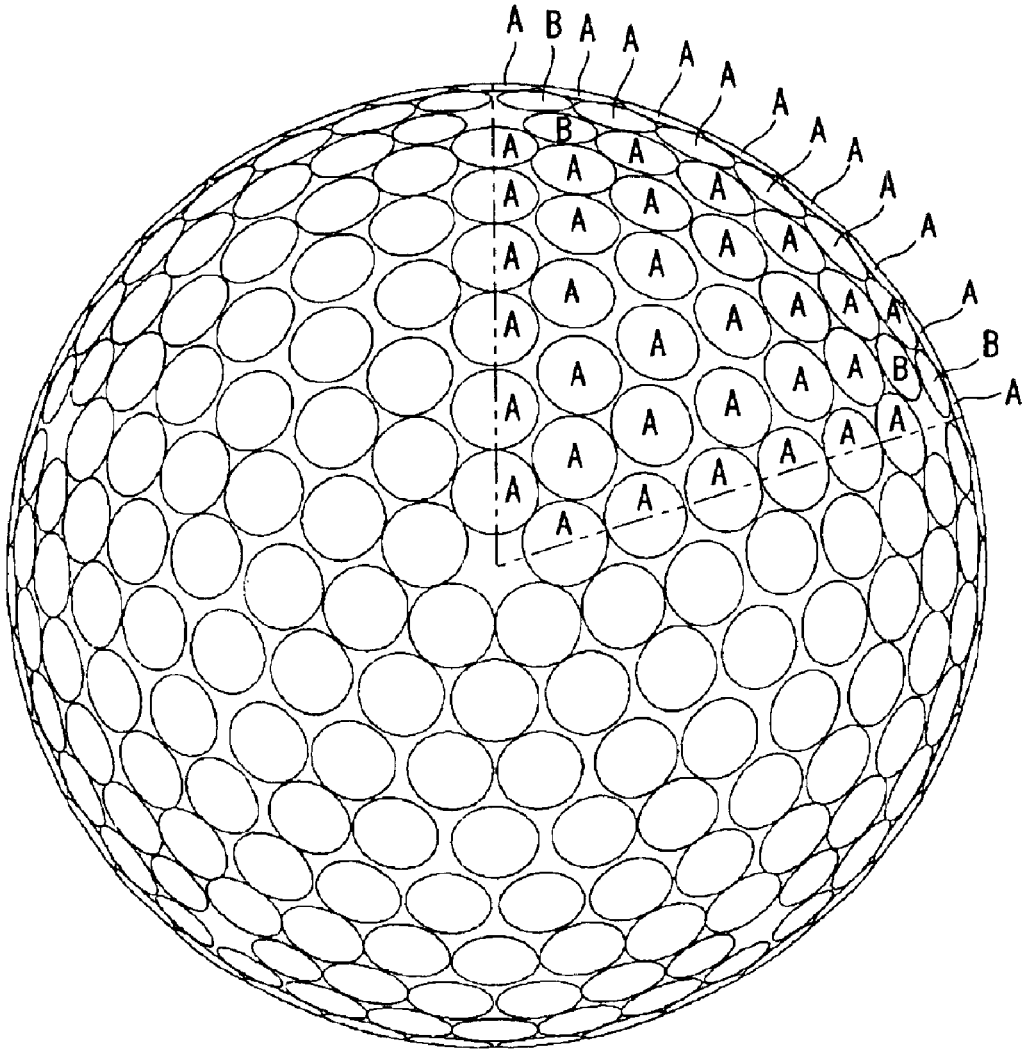
FIG. 8 is a front view showing a golf ball according to a comparative example 5.
Figure 9:
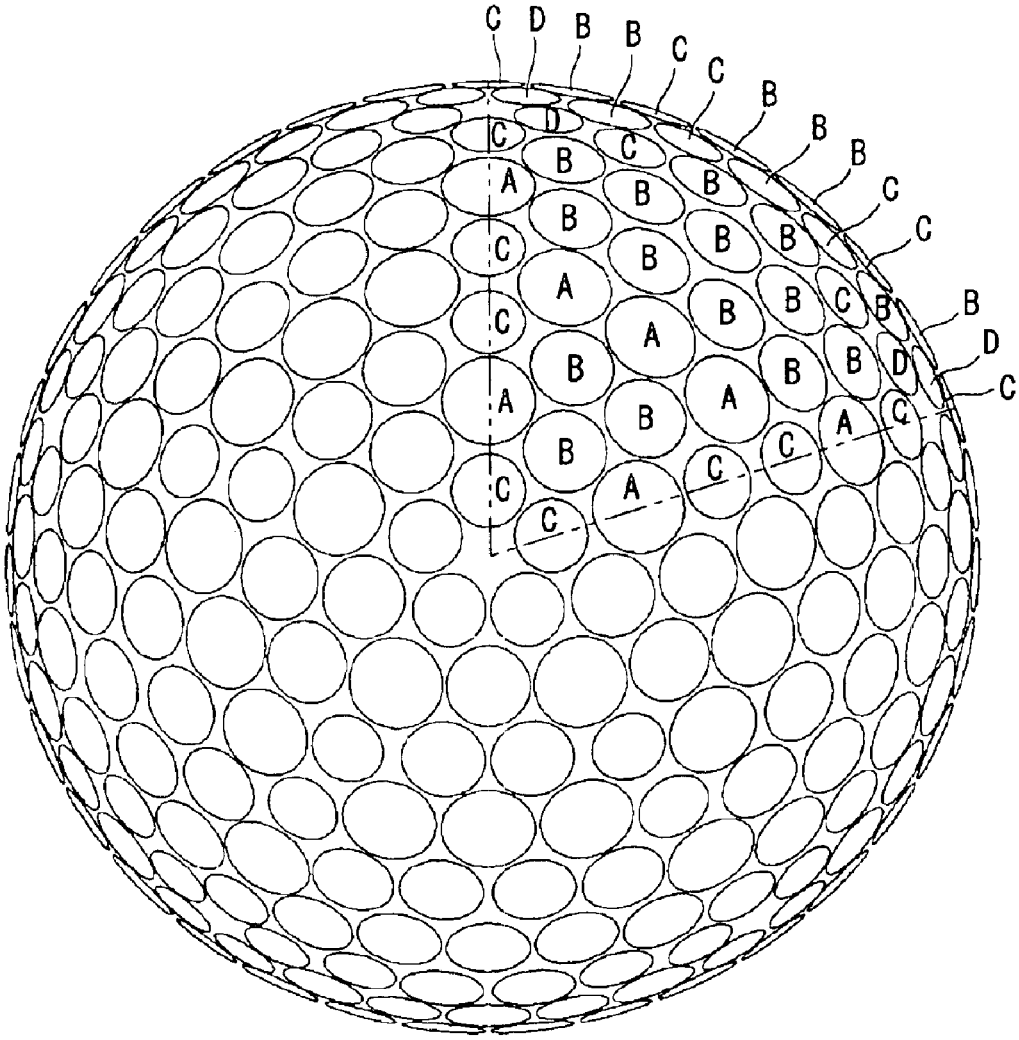
FIG. 9 is a front view showing a golf ball according to a comparative example 6.

| Specification of dimple | | | | | | | | | | | | |
|---|---|---|---|---|---|---|---|---|---|---|---|---|
| | | Number | | | | Spherical | | Volume | | Area | | |
| | Type | Number n | ratio (%) | Diameter d (mm) | Depth (mm) | surface depth (mm) | Curvature r (mm) | v ($mm^3$) | v · n ($mm^3$) | s ($mm^2$) | s · n ($mm^2$) | Dimple pattern |
| Comparative example 3 | A | 70 | 17.1 | 4.400 | 0.0950 | 0.2087 | 25.521 | 0.723 | 50.6 | 15.2 | 1064 | FIG. 3 |
| | B | 260 | 63.4 | 3.900 | 0.0950 | 0.1842 | 20.061 | 0.568 | 147.6 | 11.9 | 3106 | |
| | C | 40 | 9.8 | 3.500 | 0.3100 | 0.3818 | 5.095 | 1.507 | 60.3 | 9.6 | 385 | |
| | D | 40 | 9.8 | 3.300 | 0.3100 | 0.3739 | 4.546 | 1.341 | 53.7 | 8.6 | 342 | |
| Comparative example 4 | A | 10 | 2.4 | 4.350 | 0.1580 | 0.2691 | 15.049 | 1.176 | 11.8 | 14.9 | 149 | FIG. 7 |
| | B | 290 | 70.7 | 3.955 | 0.1580 | 0.2498 | 12.454 | 0.973 | 282.1 | 12.3 | 3563 | |
| | C | 60 | 14.6 | 2.300 | 0.1550 | 0.1860 | 4.344 | 0.324 | 19.4 | 4.2 | 249 | |
| Comparative example 5 | A | 370 | 90.2 | 3.900 | 0.1320 | 0.2212 | 14.469 | 0.790 | 292.2 | 11.9 | 4420 | FIG. 8 |
| | B | 40 | 9.8 | 3.300 | 0.1300 | 0.1939 | 10.536 | 0.557 | 22.3 | 8.6 | 342 | |
| Comparative example 6 | A | 50 | 12.2 | 4.200 | 0.1485 | 0.2520 | 14.923 | 1.030 | 51.5 | 13.9 | 693 | FIG. 9 |
| | B | 210 | 51.2 | 3.750 | 0.1485 | 0.2310 | 11.911 | 0.822 | 172.6 | 11.0 | 2319 | |
| | C | 110 | 26.8 | 3.300 | 0.1450 | 0.2089 | 9.460 | 0.622 | 68.4 | 8.6 | 941 | |
| | D | 40 | 9.8 | 3.100 | 0.1420 | 0.1983 | 8.531 | 0.537 | 21.5 | 7.5 | 302 | |

Flight Distance Test

A driver comprising a metal head was attached to a swing machine manufactured by True Temper Co. A golf ball was hit by means of the swing machine to measure a total distance. An average value of the results of 20 measurements is shown in the following Table 4. Hitting conditions are as follows.

Condition 1

Head speed: 45 m/s

Launch angle: 11 degrees

Backspin speed: 2800 rpm

Condition 2

Head speed: 40 m/s

Launch angle: 12 degrees

Backspin speed: 2600 rpm

TABLE 4

| Result of Flight Distance Test | | | | | | | | | | | |
|---|---|---|---|---|---|---|---|---|---|---|---|
| | Exam. 1 | Exam. 2 | Exam. 3 | Exam. 4 | Exam. 5 | Com. Exam. 1 | Com. Exam. 2 | Com. Exam. 3 | Com. Exam. 4 | Com. Exam. 5 | Com. Exam. 6 |
| Total number N | 410 | 410 | 410 | 410 | 410 | 410 | 410 | 410 | 360 | 410 | 410 |
| Number Na | 330 | 330 | 330 | 330 | 310 | 280 | 330 | 330 | 300 | 370 | 50 |
| Ratio PN(%) | 80.5 | 80.5 | 80.5 | 80.5 | 75.6 | 68.3 | 80.5 | 80.5 | 73.2 | 90.2 | 12.2 |
| Total volume V($mm^3$) | 314.0 | 316.7 | 313.9 | 315.0 | 312.8 | 313.3 | 326.6 | 312.2 | 313.3 | 314.4 | 314.0 |
| Volume Va($mm^3$) | 269.9 | 273.0 | 280.1 | 290.3 | 256.3 | 238.5 | 310.2 | 198.2 | 293.8 | 292.2 | 51.5 |
| Ratio PV(%) | 85.9 | 86.2 | 89.2 | 92.2 | 82.0 | 76.1 | 95.0 | 63.5 | 93.8 | 92.9 | 16.4 |
| Surface area occupation ratio Y(%) | 84 | 86 | 79 | 79 | 82 | 83 | 85 | 85 | 69 | 83 | 74 |
| Surface area occupation ratio Ya(%) | 72 | 73 | 71 | 71 | 67 | 63 | 73 | 73 | 65 | 77 | 12 |
| Difference in diameter (mm) | 0.450 | 0.550 | 0.250 | 0.250 | 0.450 | 0.450 | 0.500 | 0.500 | 0.395 | — | — |
| Distance (m) | | | | | | | | | | | |
| Condition 1 | 235.0 | 234.4 | 234.0 | 233.2 | 233.4 | 229.2 | 229.0 | 228.5 | 227.9 | 227.2 | 226.6 |
| Condition 2 | 212.3 | 213.0 | 212.1 | 211.4 | 211.3 | 208.0 | 207.0 | 206.7 | 205.8 | 208.6 | 207.3 |

As is apparent from the Table 4, the golf balls according to the examples have greater total distances than those of the golf balls according to the comparative examples. From the results of evaluation, the advantage of the present invention is obvious.

The above description is only illustrative and can be variously changed without departing from the scope of the present invention.

What is claimed is:

1. A golf ball including:

(a) at least two types of circular dimples having diameters of 3.9 mm to 4.8 mm; and (b) a non-circular dimple or a circular dimple having a diameter of less than 3.9 mm, wherein a ratio PN of a number Na of the circular dimples having the diameters of 3.9 mm to 4.8 mm to a total number N of the dimples is 75% or more, a volume Va of the circular dimples having the diameters of 3.9 mm to 4.8 mm is 200 $mm^3$ to 300 $mm^3$, a ratio PV of the volume Va to a total volume V of all the dimples is 70% to 95%, and a surface area occupation ratio Y of all the dimples is 75% or more.

2. The golf ball according to claim 1, wherein a surface area occupation ratio Ya of the circular dimples having the diameters of 3.9 mm to 4.8 mm is 65% or more.

3. The golf ball according to claim 1, wherein a difference between a diameter of the largest one of the circular dimples having the diameters of 3.9 mm to 4.8 mm and that of the smallest one of the circular dimples having the diameters of 3.9 mm to 4.8 mm is 0.6 mm or less.

* * * * *